US005397869A

United States Patent [19]

Huen

[11] Patent Number: 5,397,869

[45] Date of Patent: Mar. 14, 1995

[54] ELECTRICAL SWITCH CONTROL DEVICE

[75] Inventor: Raico H. W. Huen, Unionville, Canada

[73] Assignee: Qesco International (Canada) Ltd., Ontario, Canada

[21] Appl. No.: 999,149

[22] Filed: Dec. 31, 1992

[51] Int. Cl.[6] ..... H01H 3/20

[52] U.S. Cl. ..... 200/330

[58] Field of Search ..... 200/330, 331, 332.1

[56] References Cited

U.S. PATENT DOCUMENTS

| | | | |
|---|---|---|---|
| 2,171,267 | 8/1939 | Doty | 200/330 |
| 2,368,083 | 1/1945 | Adam | 200/330 |
| 3,171,920 | 3/1965 | Klein et al. | 200/330 |
| 4,771,145 | 9/1988 | Davis, Jr. | 200/331 |

OTHER PUBLICATIONS

Heath Zenith brochure–Passive infrared and passive infrared with timer delay devices from Heath Zenith, SL–6107 and SL–6120.

Heath Zenith brochure–wireless switch with a separate switch controlling an adaptor–like module plugged in a wall outlet from Heath Zenith, SL–6136 and SL–6133.

Home Equipment Mfg. Co. (HEMCO) brochure–light sensor with timer, installed between the light bulb and the light bulb socket, that works like a night–light from Home Equipment Mfg. Co., SLC–4T and FLC 7.

Home Equipment Mfg. Co. (HEMCO) brochure–Light sensor with timer delay from Home Equipment Mfg. Co., WT–1.

Pro Hardware 1991 Fall/Winter Catalogue (Canada), p. 42, see two highlighted boxes–top highlighted box, item B, Noma timer–lower highlighted box, item A, Noma electronic digital timer–lower highlighted box, item B, Ingraham timer–lower highighted box, item C, Noma timer–lower highlighted box, item D, Ingraham timer–lower highlighted box, item E, Ingraham timer–lower highlighted box, item F, Noma timer–lower highlighted box, iten G, Noma timer.

Canadian Tire 1992 Catalogue, pp. 96 and 100, see highlighted items–p. 96, item 7, Leviton timer–p. 96, item 8, Leviton timer delay passive infrared motion sensor–p. 100, item 12, Intermatic electronic digital timer–p. 100, item 13, Intermatic timer–p. 100, item 14, Intermatic electronic digital timer–p. 100, item 16, Intermatic timer.

Digital timer with LCD display from MasterCraft, 52–8843–2.

Mechanical timer plugged in wall outlet from MasterCraft, 52–8861–8.

Digital timer in "Mastercraft" packaging, 52–8851–2, but device labelled "Intermatic".

(List continued on next page.)

*Primary Examiner*—Renee S. Luebke

*Attorney, Agent, or Firm*—Bell, Seltzer, Park & Gibson

[57] ABSTRACT

A battery-operated automatic electrical switch control device to be mounted on an existing wall switch. A back frame is mounted behind the existing switch plate and a casing containing the electric circuitry and moving components of the device clips around the switch plate and onto the frame. Inside the casing is a printed circuit board wired to a DC motor that drives a cam. The printed circuit board is connected to a sensor or timing component, also in the casing, which signals the turning on or off of the switch. Such a signal, which may originate from a remote control unit or from changes in the local environment, is passed on to the motor, which drives the cam to rotate. The cam follower has on its tip a claw which grasps the actuating knob of the wall switch. The linear movement of the cam follower in response to the turning cam causes the knob to be pushed up or down, turning the switch on or off accordingly. Alternatively, a manual override button on the casing can be used to cause the motor to drive the cam follower and turn the switch on or off.

28 Claims, 10 Drawing Sheets

OTHER PUBLICATIONS

Home Hardware 1991 Spring/Summer Catalogue (Canada), p. 39, see highlighted items–highlighted items–item 41, Intermatic electronic timer–item 43, Decora timer delay device.

The Official Directory and Buyers Guide of the 1992 National Hardware Show, Chicago, Ill., 1992–advertisement for the Air Switch (Lectric Air) from Tridelta Industries, Inc.

"The Clapper", a switch activated by clapping hands or the like.

Radio Shack advertisement, 1993, see highlighted item–Passive infrared device.

Passive infrared device with timer delay from Radio Shack, source currently unavailable.

Passive infrared device from Power Smart, source currently unavailable.

Passive infrared device with timer delay from Power Smart, source currently unavailable.

Timer with slide switches from Leviton, source currently unavailable.

Timer with slide switches from Power Smart, source currently unavailable.

Timer delay device from Power Smart, source currently unavailable.

Mechanical timer plugged in wall outlet from First Alert, source currently unavailable.

Infrared wireless control with a remote control unit which controls an adaptor–like module plugged in the wall outlet, brand unknown, seen at National Hardware Show, Chicago, Ill. 1992.

ELECTRICAL SWITCH CONTROL DEVICE

FIELD OF THE INVENTION

This invention relates to devices for the automatic control of electrical switches.

BACKGROUND OF THE INVENTION

The ability to turn an electrical switch on or off automatically in one's absence or in response to certain changes in the local environment presents certain advantages. For example, using a timer control to turn lights, appliances and the like on and/or off at specific times can enhance the security of a home or office. Energy can be conserved by such a program, and associated costs reduced accordingly. Ease and convenience are additional advantages.

In general, automatic switch control involves devices coupled to the existing AC circuit. These include timer control and time delay control devices, as well as devices incorporating certain sensors that respond to changes in the local environment. Such sensors include passive infrared (PIR) sensors, which respond to changes in heat (including body heat), and cadmium sulfide (CdS) photosensors, which respond to changes in light. In addition, remote control using, for instance, infrared or radio signals can be used for automatic switch control.

In general, the many existing electronic and mechanical products for automatic switch control fall into two broad categories: permanently installed devices and plug-in/add-on devices.

In the former case, the existing switch is removed from the site where automatic switch control is desired, and an automatic control device with a switch is installed in its place. In addition to being a waste of the existing switch, there are other drawbacks to this approach. Re-wiring is necessary to install such a device, or to remove it, if so desired at a later time. With re-wiring, there is always a risk of electrical shock. This risk, plus the knowledge of electrical wiring and the work required for installation, can often discourage an ordinary person from using a permanently installed automatic switch control device. Moreover, the power consumption of lighting or appliances controlled by such a device may be limited by the device itself. Usually, the usable range is limited to 100 W to 600 W.

In contrast, the plug-in/add-on devices of the second broad category of automatic switch control devices do not require rewiring. Here, the light or appliance to be controlled automatically is plugged into a separate control module which is in turn plugged into a wall outlet. The control module may incorporate a timer, or may sense changes in the environment. These may be changes in heat, light or sound (for instance, hands clapping). Plug-in/add-on devices are limited to plug-in applications. In addition, they can sometimes be cumbersome. In use, one socket of a standard wall outlet must be reserved for the control module, and the module sometimes blocks the second socket.

SUMMARY OF THE INVENTION

The present invention provides, in one broad aspect, a removable electrical switch control device for use with a separate switch, the switch having a switch actuator. The device has a coupler adapted to mechanically engage the switch actuator, a driver mechanically connected to the coupler, and a control element electrically connected to the driver. The control element activates the driver, which in turn drives the coupler to actuate the switch actuator.

The driver may have a cam, a cam follower and a motor mechanically connected to the cam for driving the cam in rotational movement. The cam follower has two ends, a first end that is mounted to the cam such that rotational movement of the cam produces up and down movement of the cam follower, and a second end that is attached to the coupler.

The control element of the electrical switch control device may have a printed circuit board with circuitry electrically connected to the motor, and signal-responsive means electrically connected to the printed circuit board.

The device may have a hollow casing that contains and supports the cam, the cam follower, the coupler, the motor, the printed circuit board and the signal-responsive means.

The switch used with the device may have a switch plate, and the device a frame for mounting behind the switch plate. The frame can be attached to the casing using two clips on the casing.

The device may have a release button on the casing. When the casing has been previously mounted on the frame, manually pressing the release button causes at least one of the clips to be moved, thus releasing the casing from the frame.

The device may have an override button electrically connected to the printed circuit board and protruding from the casing. Manually pressing the override button causes a signal to be sent to the motor to drive the cam.

The signal-responsive means of the device may be a sensor that responds to changes in a local environment of the device. It may responds to changes in heat, in light or in sound. Alternatively, the signal-responsive means may be a timing component. The timing component may be a timer or a time delay circuit.

The signal-responsive means may respond to signals sent from a remote control unit. These signals may be in the form of radio waves or of infrared radiation.

The casing of the electrical switch control device may be adapted for mounting of the remote control unit. The casing may have a power interruptor in it, with a power interruptor actuator protruding from the casing. The mounting of the remote control unit on the casing in contact with the power interruptor actuator turns the device off, and its dismounting turns the device on.

BRIEF DESCRIPTION OF THE DRAWINGS

For a better understanding of the present invention and to show more clearly how it may be carried into effect, reference will now be made by way of example to the accompanying drawings, which show the preferred embodiments of the present invention and in which.

DETAILED DESCRIPTION OF THE PREFERRED EMBODIMENTS

Figure 1:
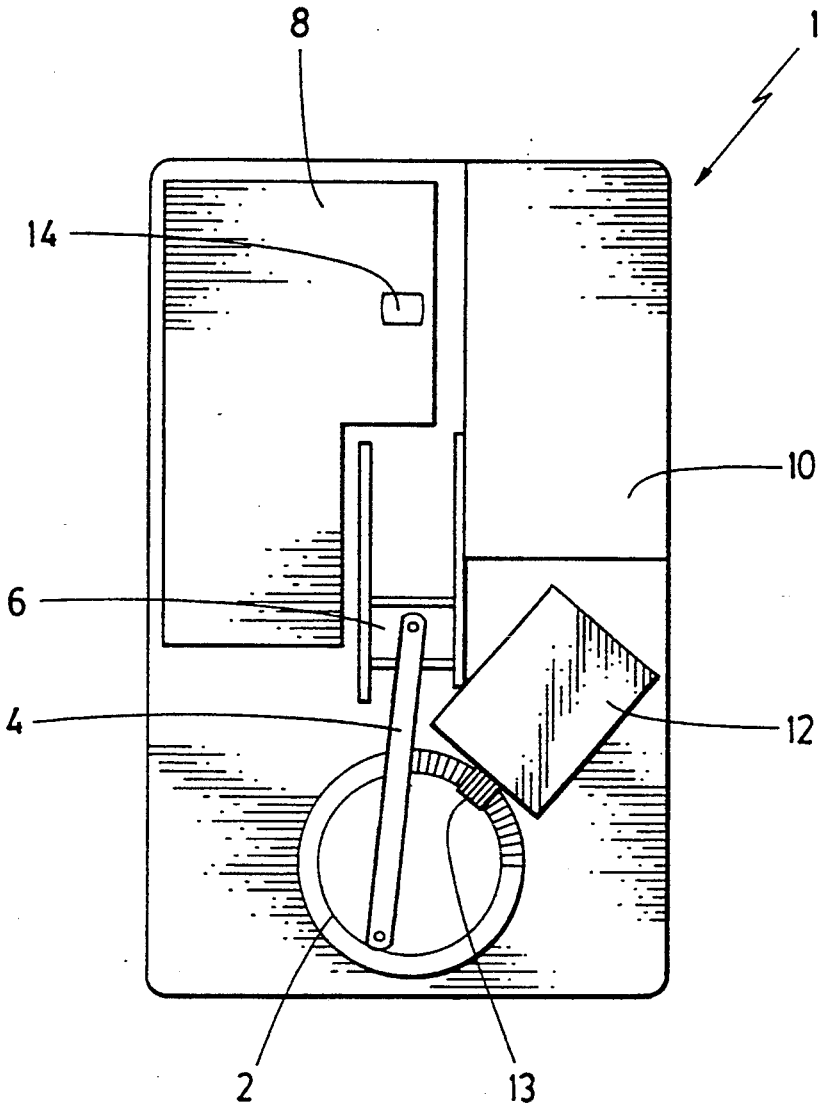
FIG. 1 is a front view of the interior of an electrical switch control device according to the preferred embodiment of the present invention.

Referring to FIG. 1, an electrical switch control device 1 has a circular toothed cam 2, to which one end of a cam follower 4 is connected. At the opposite end of the cam follower 4 is a coupler 6. A printed circuit board 8 is connected to a battery 10, that is used with, but does not form part of, the device 1, and to a DC motor 12. The motor 12 is connected to a toothed gear 13. The gear 13 engages the cam 2.

The rotation of the cam 2 is driven through the gear 13 by the motor 12. The motor 12 is powered by the battery 10. The action of the motor 12 is controlled by circuitry on the printed circuit board 8, to which the motor 12 is electrically connected.

Figure 9:
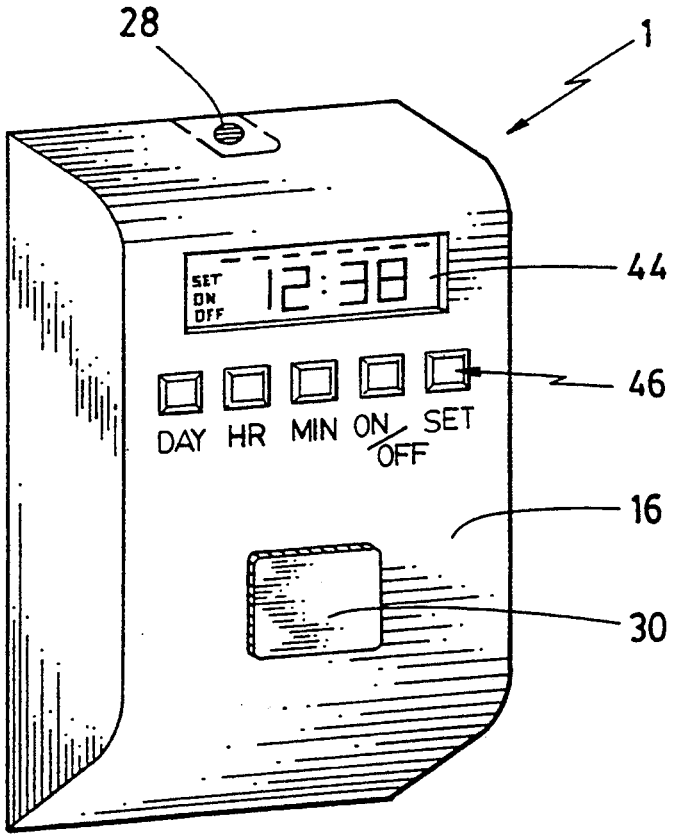
FIG. 9 is a front view of an electrical switch control device according to the preferred embodiment of the present invention for a timer application.
Figure 10:
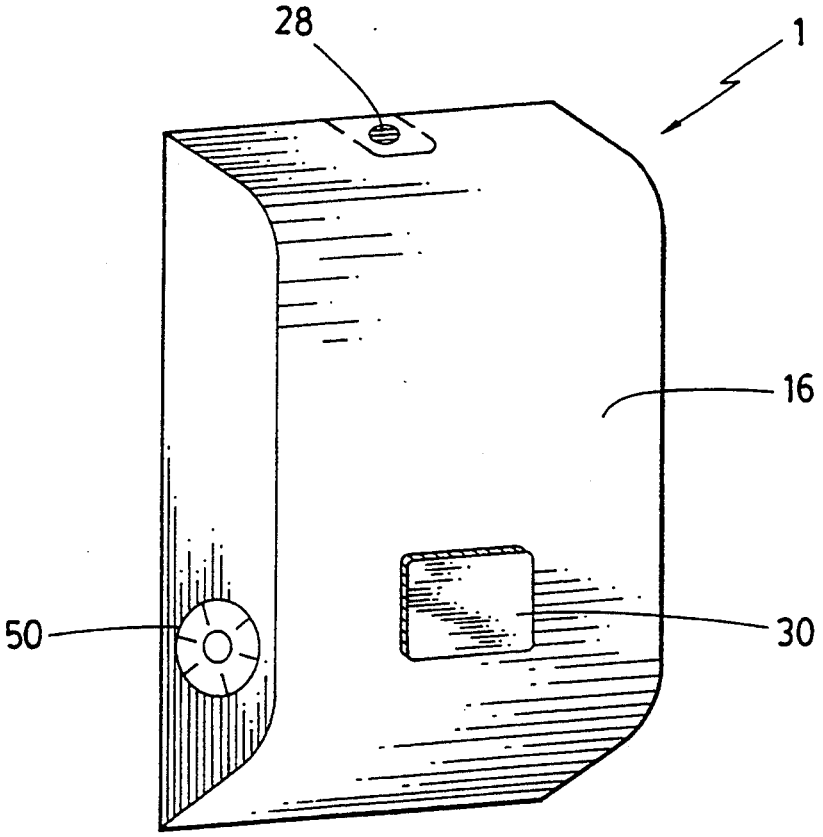
FIG. 10 is a front view of an electrical switch control device according to the preferred embodiment of the present invention for a time delay circuit application.

The printed circuit board 8 is electrically connected to a sensor 14 that responds to external signals. An example of such signals may be changes in the light or heat of the surrounding environment; remote control signals sent via electromagnetic waves; or sounds, such as hands clapping. Alternatively, the printed circuit board 8 is electrically connected to other signal-responsive means, for example, a timing component, such as a timer or a time delay circuit, which applications are shown in FIGS. 9 and 10, respectively. Taken together, the printed circuit board and the signal-responsive means are a control element of the device 1.

Figures 2, 2A:
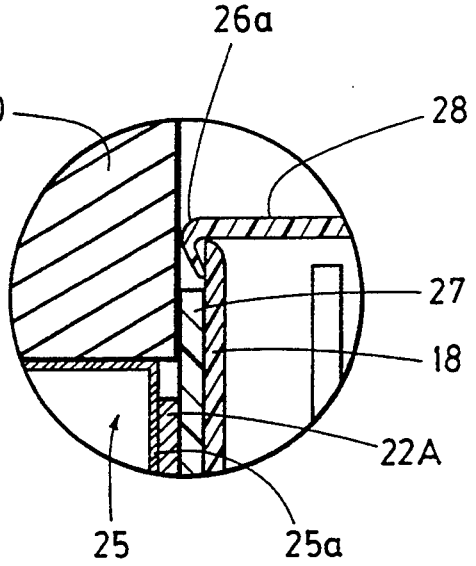
FIG. 2A is a cross-sectional side view of the device of FIG. 1, shown with a casing and shown operating on a standard lever type switch actuator, the switch actuator being in a "down" position.
Figures 1, 2A:
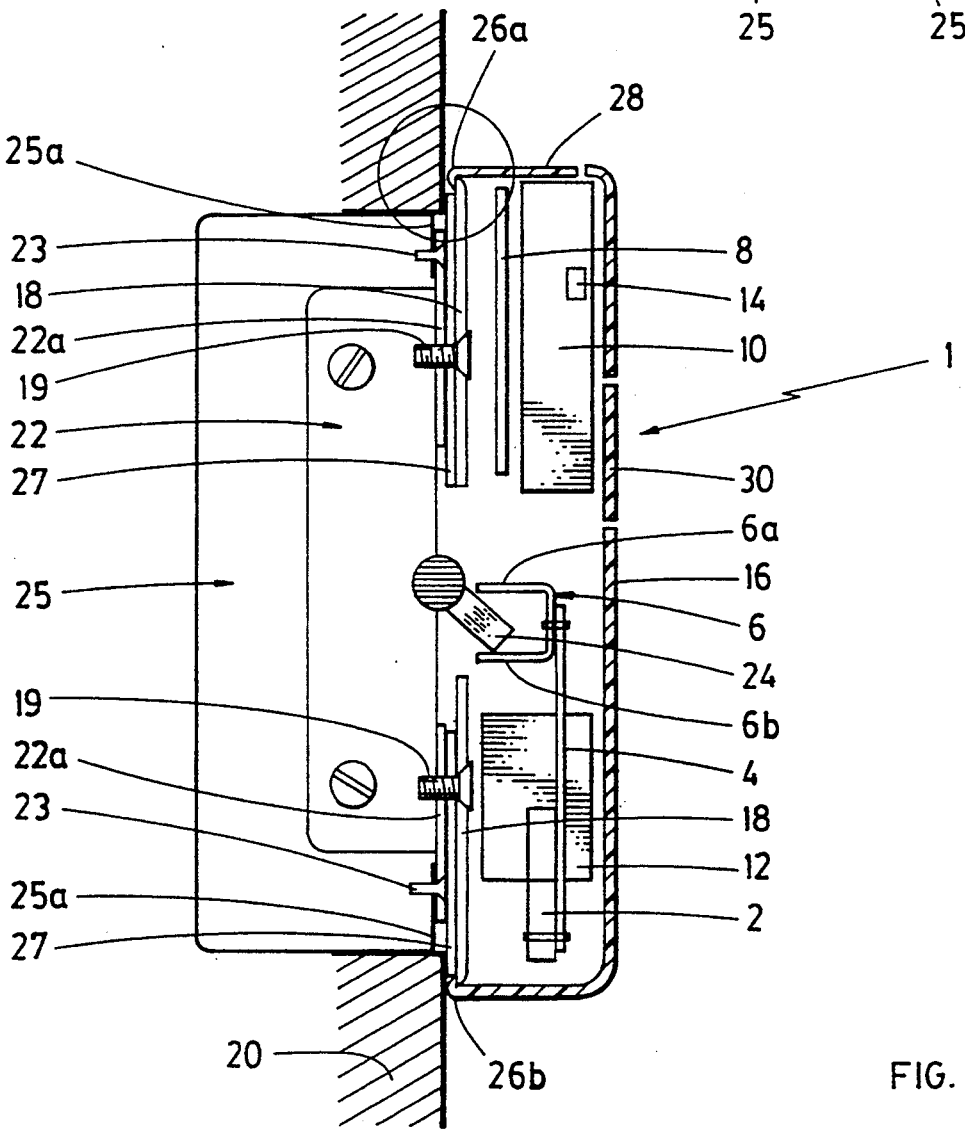
Figures 2, 2B:
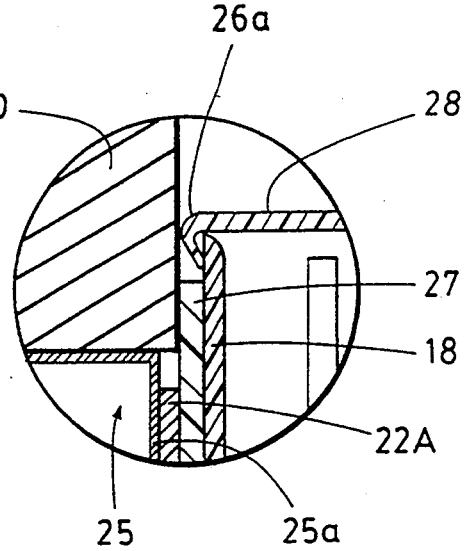
FIG. 2B is a cross-sectional side view of the device of FIG. 1, shown with a casing and shown operating on a standard lever type switch actuator, the switch actuator being in an "up" position.
Figures 1, 2B:
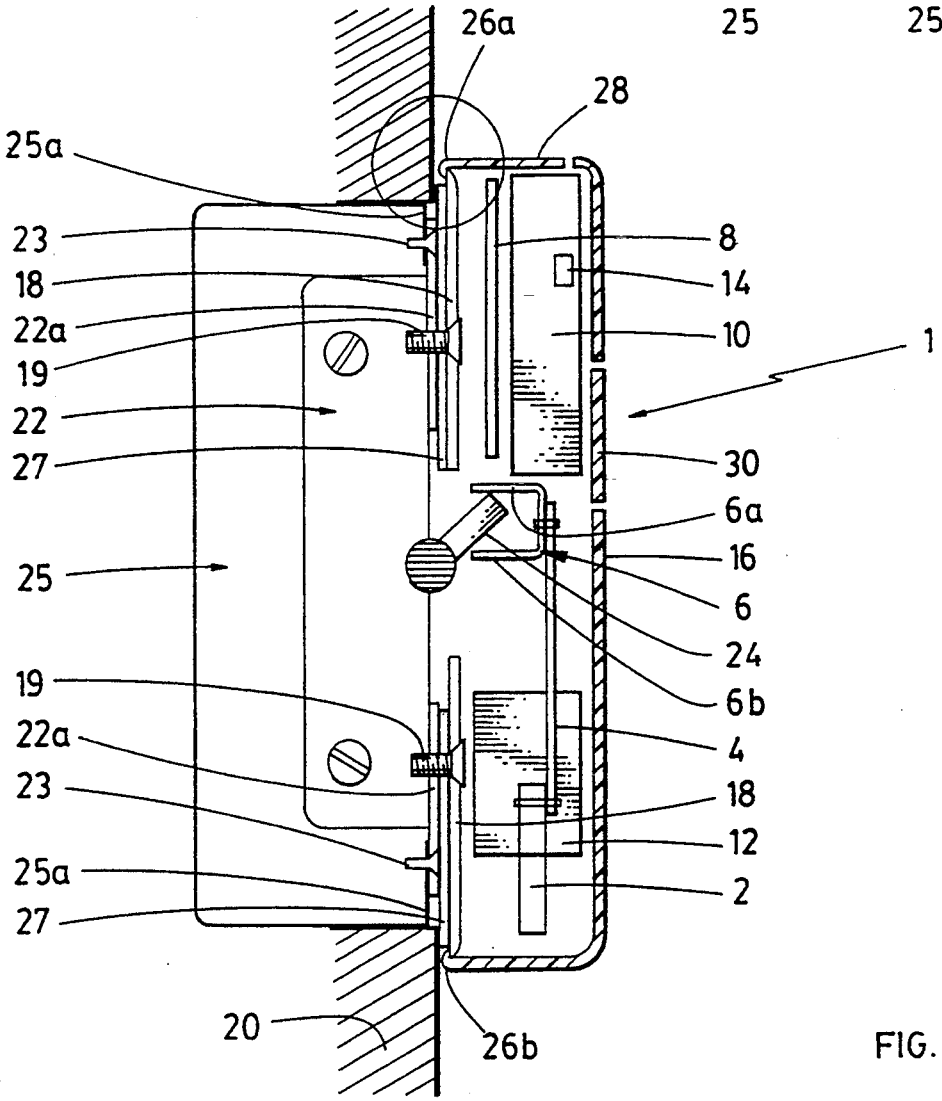

Referring to FIGS. 2A and 2B, the cam 2, the cam follower 4, the coupler 6, the printed circuit board 8 and the motor 12 are contained in a casing 16 that forms part of the device 1. The coupler 6 has upper and lower prongs 6*a* and 6*b*, respectively. At the top and bottom of the casing 16 are two resilient clips 26*a* and 26*b*, respectively.

The device 1 is mounted over a separate switch plate 18 having screws 19, which does not form part of the device 1. Behind the switch plate 18 and in a wall 20 is a switch 22 having flanges 22*a* and a standard lever type switch actuator 24, which also does not form part of the device 1. The screws 19 fasten the switch plate 18 to the switch 22 at the flanges 22*a*. The switch 22 rests within an electrical box 25 having flanges 25*a*. Screws 23 fasten the switch 22 to the electrical box 25 at the flanges 25*a*.

Figure 4:
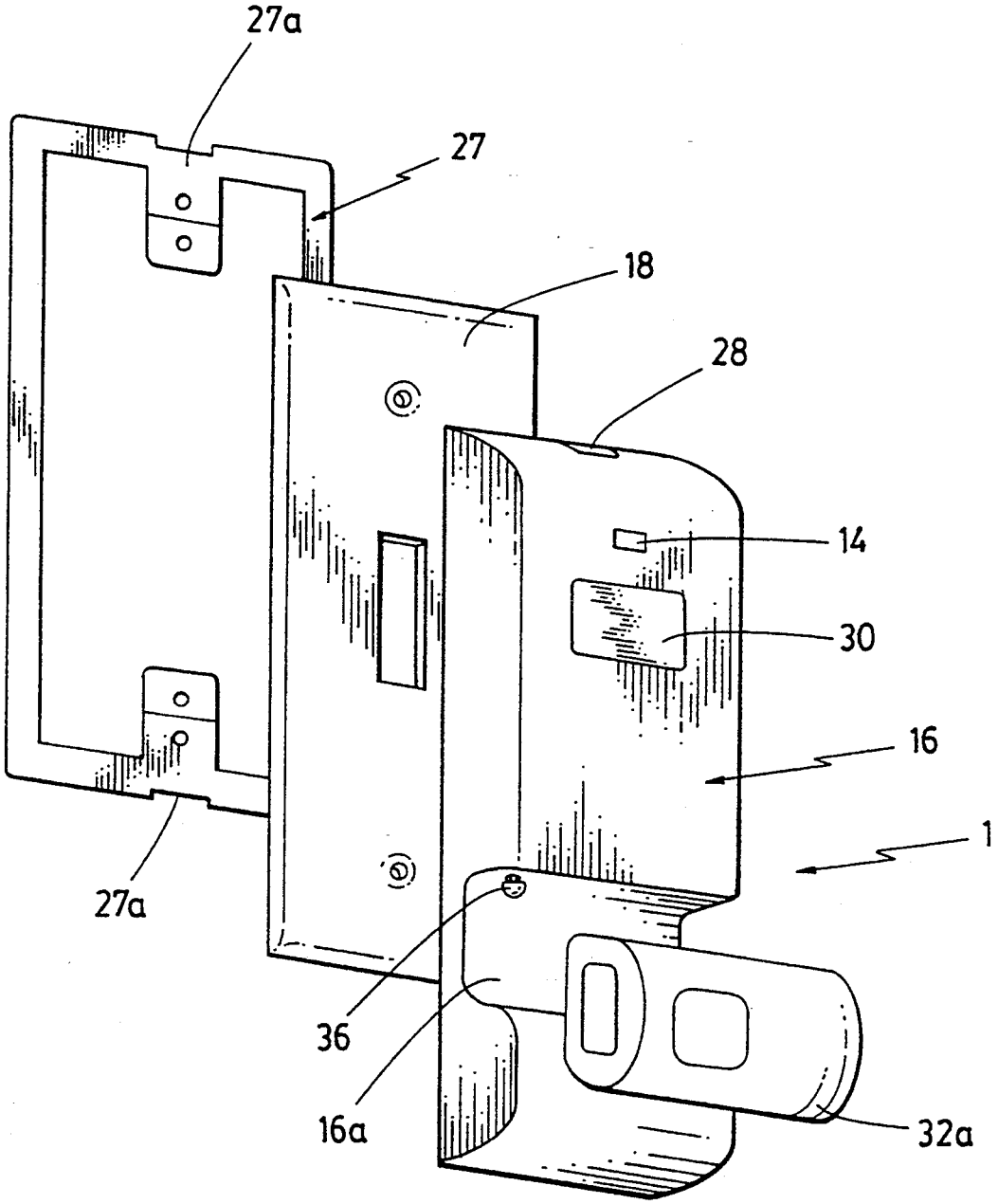
FIG. 4 is an exploded view from the front and a side of a casing and mounting components of the device of FIGS. 2A and 2B with a snap-in remote control unit, and with a standard switch plate.
Figure 5:
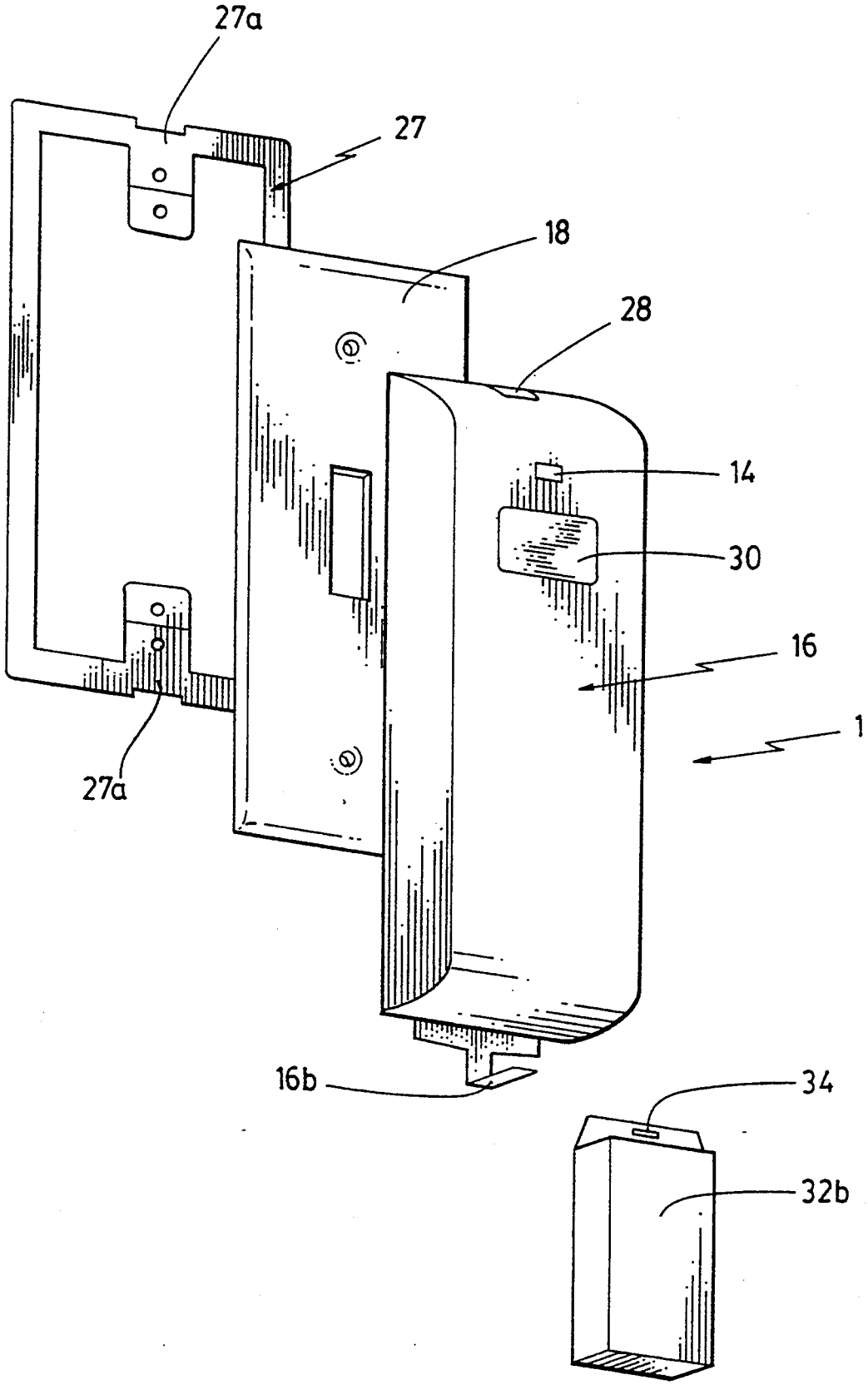
FIG. 5 is an exploded view from the front and a side of a casing and mounting components of the device of FIGS. 2A and 2B with a suspended remote control unit, and with a standard switch plate.

Referring to FIGS. 4 and 5, a frame 27 is mounted between the flanges 22*a* and the switch plate 18. The frame 27 and switch plate 18 are both secured to the flanges 22*a* by the screws 19, shown in FIGS. 2A and 2B. Referring again to FIGS. 4 and 5, the frame 27 has notches 27*a* at its top and bottom edges.

As shown in FIGS. 2A and 2B, each notch 27*a* is of a sufficient size to allow the passage of a clip 26*a* or 26*b* of the casing 16. To mount the electrical switch control device 1 on the wall 20, the clips 26*a*, 26*b* are moved around the top and bottom of the switch plate 18 to fit in the notches 27*a*. The device 1 is thus securely mounted without requiring any modification of the existing switch 22, such as rewiring.

Figure 3:
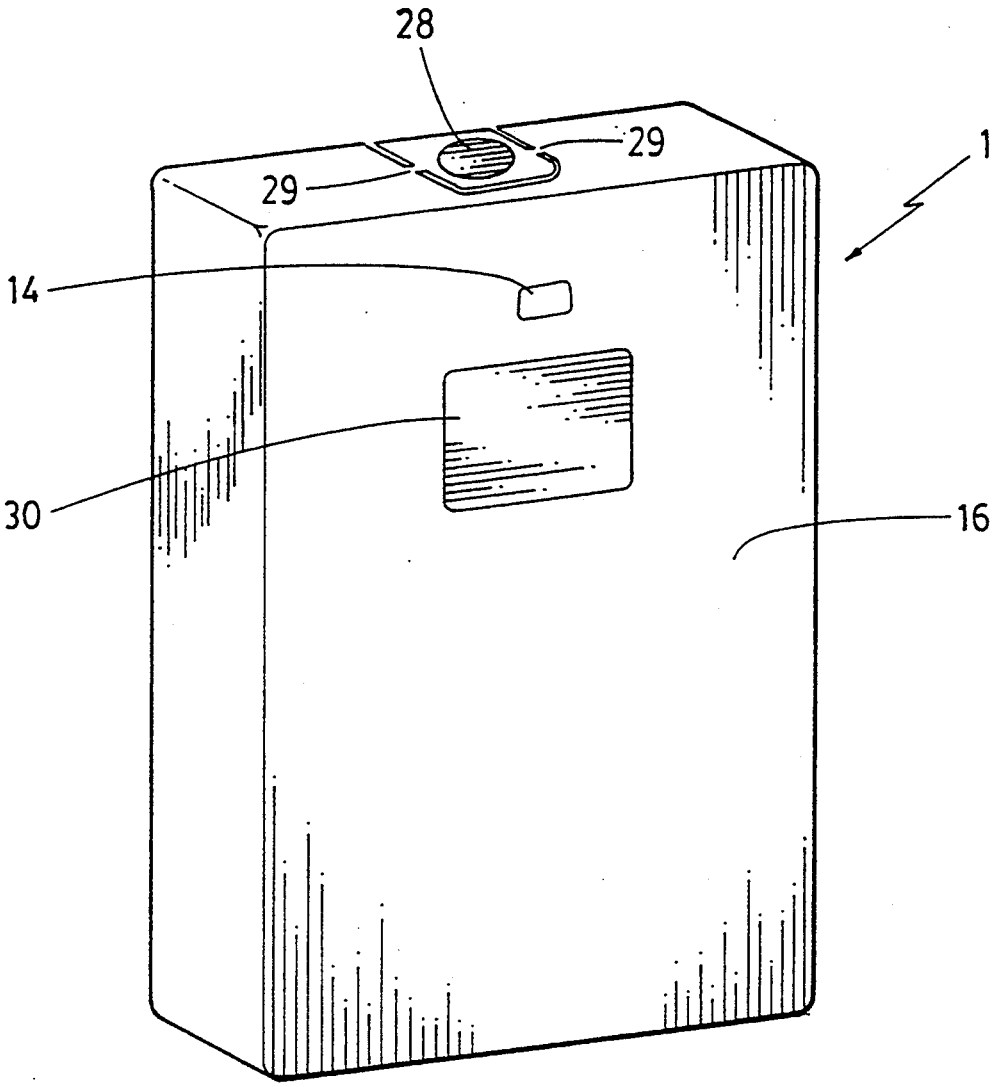
FIG. 3 is a perspective view from the front and a side of the device of FIGS. 2A and 2B.

Referring to FIG. 3, to detach the device 1 from the wall 20, a swivel release button 28 is at the top of the casing 16 and is used to move the clip 26*a* from its position in the top notch 27*a*. The button 28 is formed by removing a portion of the casing above the clip 26*a* in a U-shape, except for two bars 29.

A manual override button 30 protrudes from the front of the casing 16 and is connected electrically to the printed circuit board 8.

Figure 6B:
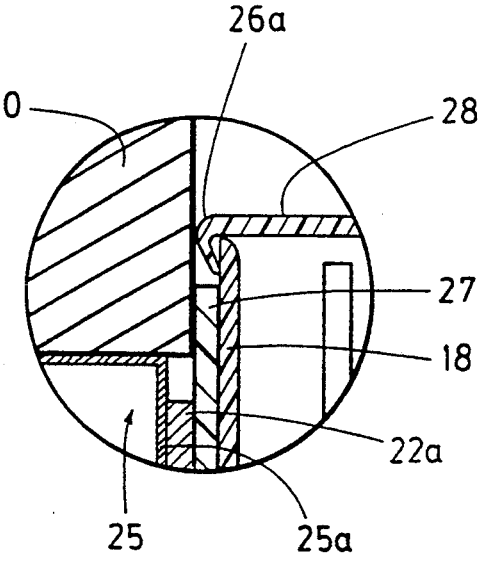
FIG. 6 is a cross-sectional side view of the device of FIG. 4.
Figure 6A:
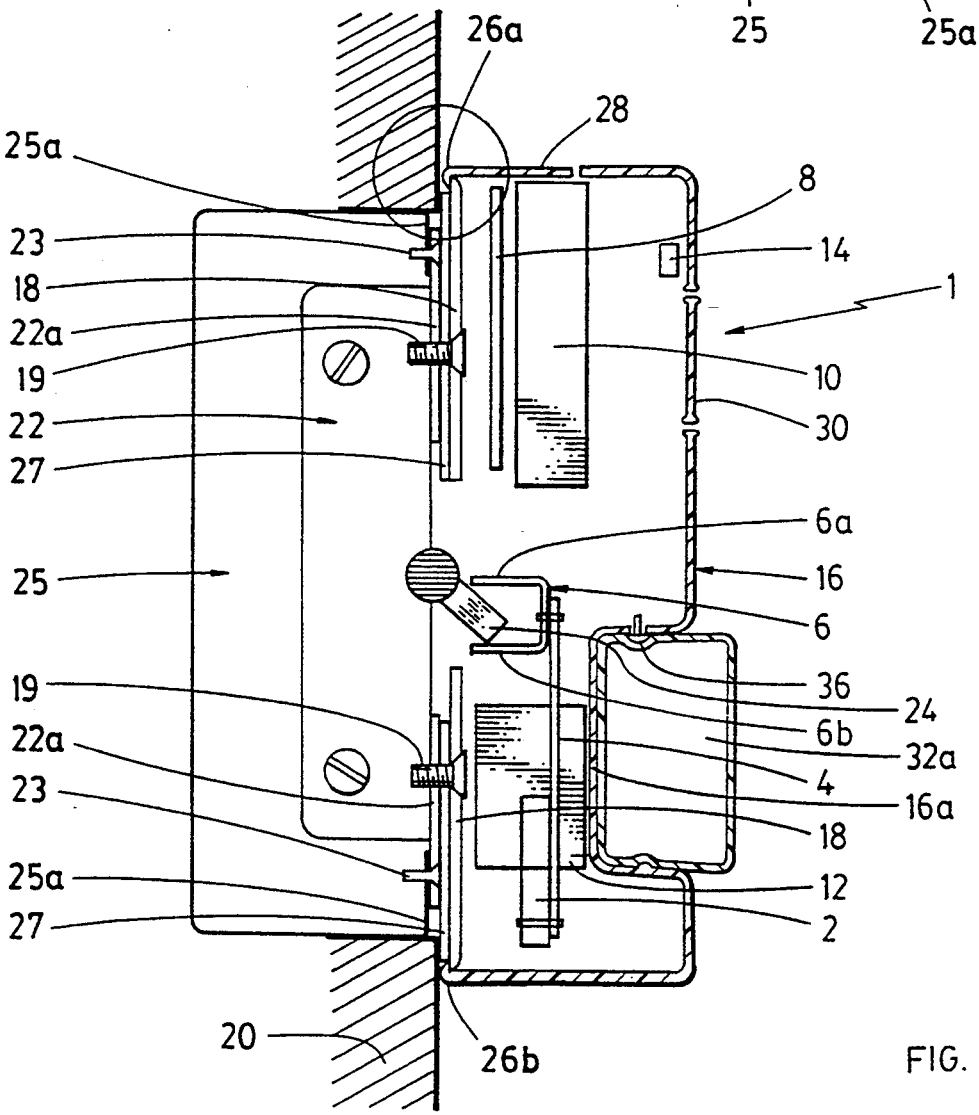

Referring again to FIGS. 4 and 5, the casing 16 may be adapted for the temporary or occasional mounting of a remote control unit 32*a* or 32*b* to which the sensor 14 and consequently the printed circuit board 8 respond. Such mounting may be effected by any convenient method. As a first example, FIGS. 4 and 6 show a channel 16*a* in the casing 16 in which a reciprocally shaped remote control unit 32*a* fits snugly. As a second example, FIG. 5 shows a hook 16*b* that extends from the bottom of the casing 16. A remote control unit 32*b* having an aperture 34 into which the hook 16*b* fits may be suspended from the casing 16 by fitting the hook 16*b* into the aperture 34.

In operation, the device 1 is added on to an existing wall switch 22 by fastening clips 26*a*, 26*b* around the switch plate 18 into the notches 27*a* of the frame 27. The prongs 6*a*, 6*b* fit above and below the switch actuator 24. The sensor 14 sends a signal via the circuitry of the printed circuit board 8 to the motor 12, which together with the cam 2 and cam follower 4 are a driver of the device 1. The motor 12 causes the cam 2 to make one-half turn. This circular movement is transformed into linear movement of the cam follower 4. The cam follower 4 causes prong 6*b* to push the switch actuator 24 upwards or prong 6*a* to pull the switch actuator 24 downwards. This turns the switch 22—and any lighting or appliances controlled by the switch 22—on or off.

Figure 7B:
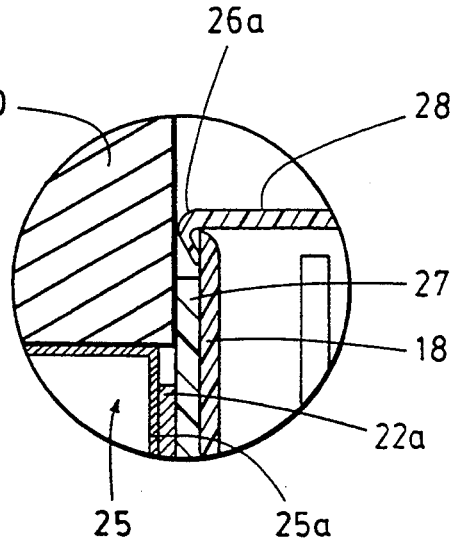
FIG. 7 is a cross-sectional side view of the device of FIG. 1, shown with a casing and shown operating on a decorative switch actuator.
Figure 7A:
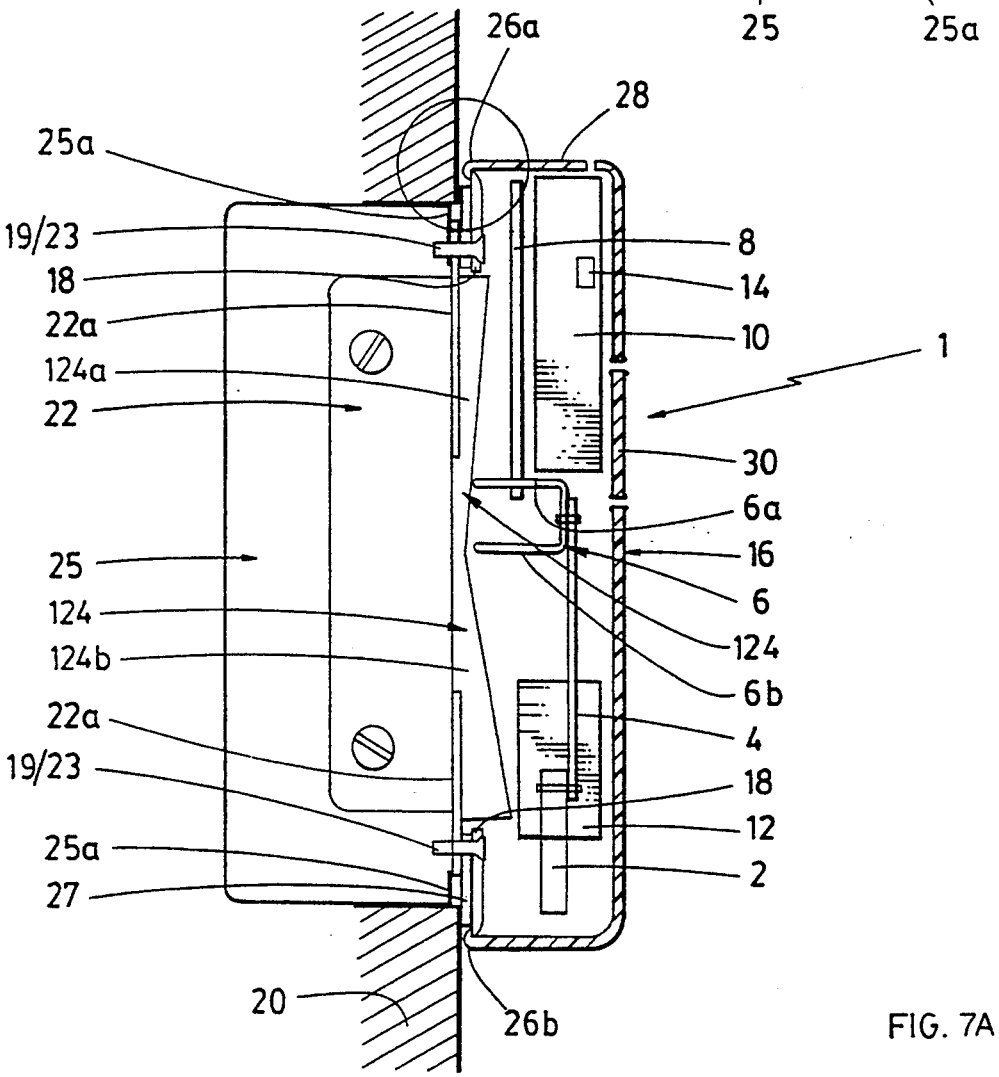

Referring to FIG. 7, the electrical switch control device 1 may be used with a decorative switch actuator 124 having a wedge-shaped upper portion 124*a* and a wedge-shaped lower portion 124*b*. When either portion 124*a* or 124*b* is pushed inwardly towards the wall 20, the switch 22 is turned on or off. The portions 124*a*, 124*b* cannot be pushed or pulled by the prongs 6*a*, 6*b* in the same manner as for a lever type switch actuator 24. However, the pressure of the prongs 6*a*, 6*b* sliding against the surface of the portion 124*a*, 124*b* when the cam follower 4 moves is sufficient to push the portion 124*a* or 124*b* inwardly and change the state of the switch 22. The prongs 6*a*, 6*b* may be adapted to have rounded edges to facilitate smooth movement against the surface of the portions 124*a*, 124*b*.

When the manual override button 30 shown in FIGS. 2–5 is pressed once, an electrical signal is sent that turns the motor 12 on and drives the cam 2 to make one-half turn. The cam follower 4 moves accordingly to push or pull the switch actuator 24 up or down. Thus, the switch 22 is turned on or off independently of the control of the sensor 14.

Referring to FIGS. 4, 6, 8A and 8B, it may be desirable for the device 1 to have a power interruptor 36 for turning the device 1 off when automatic control is not necessary for a period of time. This saves on battery 10 power.

Figure 8A:
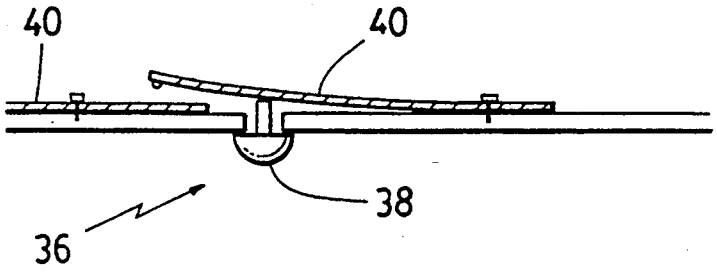
FIG. 8A is a cross-sectional side view of an on/off contact switch power interruptor in an "off" position.
Figure 8B:
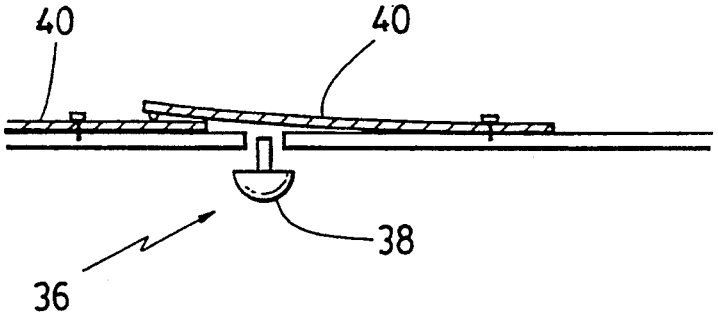
FIG. 8B is a cross-sectional side view of an on/off contact switch power interruptor in an "on" position.

Referring to FIGS. 8A and 8B, the power interruptor 36 can be a simple contact switch using a button 38 and two metallic strips 40. One strip 40 is connected to the battery 10 and the other strip 40 is connected to the printed circuit board 8. When the button 38 is pressed, a strip 40 is moved so that electrical contact between the battery 10 and the printed circuit board 8 is interrupted and power to operate the device 1 is "off". Otherwise, power is "on".

As shown in FIGS. 4 and 6, the power interruptor 36 may be positioned in such a way that power to the sensor 14 is turned off when the remote control unit 32*a* is mounted on the casing 16. In this configuration, the device 1 can only work manually. When the remote control unit 32*a* is removed from its position on the casing 16, the sensor 14 is switched on and is ready to receive signals from the remote control unit 32*a*.

By incorporating different circuitry on the printed circuit board 8, the device 1 can be made to function in different ways. For example, a timer or time delay circuit may be used as an alternative to the sensor 14. Combinations of these elements and various sensors 14, for example, PIR with time delay, may also be used.

Referring to an example of a timer application shown in FIG. 9, the device 1 is provided with a timer display 44 having set buttons 46. The display 44 and the buttons 46 are electrically connected to the circuitry on the printed circuit board 8 for automatic switch control.

Referring to an example of a time delay application shown in FIG. 10, the delay is controlled by the circuitry on the printed circuit board 8 and is set using dial 50 protruding from the side of the casing 16 of the device 1. In a second time delay example, not shown, the delay is provided by a trimmer potentiometer electrically connected to the printed circuit board 8 and inside the casing 16.

The device 1 may be adapted to use a wall-mounted remote control unit, not shown, that functions in a similar manner to the remote control unit 32*a* or 32*b*, but is actually mounted to the wall 20 in a fixed position and appears to a user to provide three-way switch control.

The device 1 may also be adapted for use with a dimmer switch, not shown. In this application, the dimmer switch does not modulate light intensity continuously; rather, the device 1 controls a state change of the switch between maximum light intensity and "off".

The device 1 presents a number of advantages over permanently installed automatic switch control devices. It can be added on to an ordinary wall switch 22 safely and with a minimum of effort. Special knowledge of electrical wiring is not required, as no modification of the existing switch 22 or rewiring is necessary. Similarly, the device 1 is easy to remove for use elsewhere if the user's needs change. The device 1 is not connected to the AC circuit, so there is no added risk of electrical shock to the user.

Unlike certain permanently installed devices, the device 1 does not limit the power consumption of the lighting or appliances controlled, because the lighting and appliances are not connected to the device 1 directly, but to the existing switch 22.

The device 1 is also preferable to the commonly manufactured plug-in/add-on switch control devices. It makes use of the existing switch 22, rather than using a socket of a wall outlet.

It will be understood that this description is made with reference to the preferred embodiment of the invention. However, it is possible to make other embodiments that employ the principles of the invention and that fall within its spirit and scope as defined by the following claims.

What is claimed is:

1. A removable electrical switch control device for use with a separate switch having a switch actuator for actuation in a first and in a second direction and having a switch plate, the device comprising:

a coupler adapted to mechanically engage the switch actuator when the coupler is moved in the first direction and when the coupler is moved in the second direction;

a bi-directional two position driver mechanically connected to the coupler for driving the coupler in the first direction when the driver is activated in the first position and for driving the coupler in the second direction when the driver is activated in the second position, the driver comprising a cam pivotally mounted about an axis of rotation;

a cam follower having two ends, a first end being pivotally mounted to the cam about a second axis of rotation, the first axis of rotation and the second axis of rotation being separate, such that rotational movement of the cam produces back and forth movement of the cam follower, and a second end being attached to the coupler, the second end driving the coupler in the first and second direction with the back and forth movement of the cam follower; and a motor;

a control element electrically connected to the driver for activating the driver;

said motor being mechanically connected to the cam and electrically connected to the control element for driving the cam in rotational movement upon activation by the control element;

a removably mountable casing for enclosing the coupler, the driver, and the control element over the switch plate without modification to the switch plate, said cam being pivotally mounted to the casing;

wherein the control element activates the driver, which in turn drives the coupler to actuate the switch actuator.

2. The device of claim 1, wherein the control element comprises:

a printed circuit board with circuitry electrically connected to the motor; and signal-responsive means electrically connected to the printed circuit board.

3. The device of claim 1, further comprising a frame for mounting behind the switch plate and at least two clips on the casing, the clips for attaching the casing to the frame.

4. The device of claim 3, further comprising a release button on the casing, wherein manually pressing the release button causes at least one of the clips to be moved such that, when the casing has been previously mounted on the frame, the casing is released from the frame.

5. The device of claim 4, wherein the control element further comprises a sensor that responds to changes in a local environmental condition of the device selected from the group consisting of heat, light and sound.

6. The device of claim 5, wherein the control element further comprises a sensor that responds to signals sent from a remote control unit.

7. The device of claim 1, further comprising an override button electrically connected to the control element and protruding from the casing, wherein manually pressing the override button causes a signal to be sent to the motor to drive the cam.

8. A removable electrical switch control device for use with a separate switch having a switch actuator for actuation in a first and in a second direction and having a switch plate, the device comprising:

a coupler adapted to mechanically engage the switch actuator when the coupler is moved in the first direction and when the coupler is moved in the second direction;

a bi-directional two position driver mechanically connected to the coupler for driving the coupler in the first direction when the driver is activated in the first position and for driving the coupler in the second direction when the driver is activated in the second position;

a control element electrically connected to the driver for activating the driver;

a removably mountable casing for enclosing the coupler, the driver, and the control element over the switch plate without modification to the switch plate; and a frame for mounting behind the switch plate and at least two clips on the casing, the clips for attaching the casing to the frame;

wherein the control element activates the driver, which in turn drives the coupler to actuate the switch actuator.

9. The device of claim 8, further comprising a release button on the casing, wherein manually pressing the release button causes at least one of the clips to be moved such that, when the casing has been previously mounted on the frame, the casing is released from the frame.

10. The device of claim 8, wherein the control element further comprises a sensor that responds to a predetermined change in a local environmental condition of the device selected from the group consisting of heat, light and sound, and the control element activates the driver after the sensor responds to the predetermined change.

11. The device of claim 8, wherein the control element comprises a sensor and a timing component, the sensor responding to pre-determined timing signals from the timing component, and the control element activating the driver after the sensor responds to the pre-determined timing signals.

12. The device of claim 8, wherein the control element further comprises a sensor that responds to predetermined signals sent from a remote control unit, and the control element activates the driver after the sensor responds to the pre-determined signals.

13. The device of claim 8, wherein the clips are integrally formed with the casing.

14. A removable electrical switch control device for use with a separate switch having a switch actuator and a switch plate, the device comprising:

a coupler adapted to mechanically engage the switch actuator;

a driver mechanically connected to the coupler for driving the coupler, the driver having:

a cam;

a cam follower having two ends, a first end being mounted to the cam such that rotational movement of the cam produces movement of the cam follower, and a second end being attached to the coupler; and a motor mechanically connected to the cam for driving the cam in rotational movement;

a control element electrically connected to the driver for activating the driver;

a hollow casing that contains and supports the cam, the cam follower, the coupler, the driver, and the control element over the switch plate without modification to the switch plate;

a frame for mounting behind the switch plate and at least two clips on the casing, the clips for attaching the casing to the frame;

a release button on the casing; and an override button electrically connected to the control element;

wherein the control element activates the driver, which in turn drives the coupler to actuate the switch actuator;

wherein manually pressing the release button causes at least one of the clips to be moved such that, when the casing has been previously mounted on the frame, the casing is released from the frame;

and wherein manually pressing the override button causes a signal to be sent to the motor to drive the cam.

15. The device of claim 14, wherein the control element further comprises a sensor that responds to changes in a local environment of the device.

16. The device of claim 15, wherein the sensor responds to changes in heat.

17. The device of claim 15, wherein the sensor responds to changes in light.

18. The device of claim 15, wherein the sensor responds to changes in sound.

19. The device of claim 14, wherein the control element comprises a sensor and a timing component.

20. The device of claim 19, wherein the timing component is a timer.

21. The device of claim 19, wherein the timing component is a time delay circuit.

22. The device of claim 14, wherein the control element further comprises a sensor that responds to signals sent from a remote control unit.

23. The device of claim 22, wherein the signals are in the form of radio waves.

24. The device of claim 22, wherein the signals are in the form of infrared radiation.

25. The device of claim 22, wherein the casing is adapted for the mounting of the remote control unit.

26. The device of claim 25, further comprising a power interruptor in the casing, the power interruptor having a power interruptor actuator protruding from the casing, wherein the mounting of the remote control unit on the casing in contact with the power interruptor actuator turns power to the sensor off.

27. The device of claim 26, wherein the dismounting of the remote control unit on the casing in contact with the power interrupt or actuator turns power to the sensor on.

28. A removable electrical switch control device for use with a separate switch having a switch actuator for actuation in a first and in a second direction and having a switch plate, the device comprising:

a coupler adapted to mechanically engage the switch actuator when the coupler is moved in the first direction and when the coupler is moved in the second direction;

a bi-directional two position driver mechanically connected to the coupler for driving the coupler in the first direction when the driver is activated in the first position and for driving the coupler in the second direction when the driver is activated in the second position, the driver having:

a cam pivotally mounted about an axis of rotation;

a cam follower having two ends, a first end being pivotally mounted to the cam about a second axis of rotation, the first axis of rotation and the second axis of rotation being separate, such that rotational movement of the cam produces back and forth movement of the cam follower, and a second end being attached to the coupler, the second end driving the coupler in the first and second direction with the back and forth movement of the cam follower; and a motor;

a control element electrically connected to the driver for activating the driver, the control element having a sensor that responds to pre-determined signals sent from a remote control unit, and the control element activates the driver after the sensor responds to the predetermined signals;

said motor being mechanically connected to the cam and electrically connected to the control element for driving the cam in rotational movement upon activation by the control element;

a removably mountable casing for enclosing the coupler, the driver, and the control element over the switch plate without modification to the switch plate, said cam being pivotally mounted to the casing;

a release button on the casing;

a frame for mounting behind the switch plate and at least two clips on the casing, the clips for attaching the casing to the frame; and a power interruptor in the casing, the power interruptor having a power interruptor actuator protruding from the casing;

wherein the control element activates the driver, which in turn drives the coupler to actuate the switch actuator;

wherein manually pressing the release button causes at least one of the clips to be moved such that, when the casing has been previously mounted on the frame, the casing is released from the frame;

wherein the casing is adapted for mounting of the remote control unit;

wherein mounting of the remote control unit on the casing in contact with the power interruptor actuator turns power to the sensor off; and wherein dismounting of the remote control unit from the casing turns power to the sensor on.

* * * * *